US009957812B2

(12) United States Patent
Okita et al.

(10) Patent No.: US 9,957,812 B2
(45) Date of Patent: May 1, 2018

(54) IMPINGEMENT COOLING MECHANISM, TURBINE BLADE AND CUMBUSTOR

(71) Applicant: IHI Corporation, Tokyo (JP)

(72) Inventors: Yoji Okita, Tokyo (JP); Shu Fujimoto, Tokyo (JP); Chiyuki Nakamata, Tokyo (JP)

(73) Assignee: IHI CORPORATION (JP)

( * ) Notice: Subject to any disclaimer, the term of this patent is extended or adjusted under 35 U.S.C. 154(b) by 398 days.

(21) Appl. No.: 14/302,659

(22) Filed: Jun. 12, 2014

(65) Prior Publication Data

US 2014/0290257 A1 Oct. 2, 2014

Related U.S. Application Data

(63) Continuation of application No. PCT/JP2012/082314, filed on Dec. 13, 2012.

(30) Foreign Application Priority Data

Dec. 15, 2011 (JP) ..... 2011-274929

(51) Int. Cl.

| | |
|---|---|
| ***F01D 5/00*** | (2006.01) |
| ***F01D 5/18*** | (2006.01) |
| ***F23R 3/00*** | (2006.01) |

(52) U.S. Cl.

CPC ..... *F01D 5/187* (2013.01); *F01D 5/189* (2013.01); *F23R 3/002* (2013.01); *F23R 3/005* (2013.01);

(Continued)

(58) Field of Classification Search

CPC ..... Y02E 20/16; F05D 2260/205; F05D 2260/2322; F05D 2250/241;

(Continued)

(56) References Cited

U.S. PATENT DOCUMENTS 4,338,780 A * 7/1982 Sakamoto ..... F01D 5/087 415/114
4,399,652 A * 8/1983 Cole ..... F02C 3/22 60/39.465

(Continued)

FOREIGN PATENT DOCUMENTS

EP 2218968 A2 8/2010
EP 2233693 A1 9/2010

(Continued)

OTHER PUBLICATIONS

European Search Report, dated Sep. 29, 2015, issued in corresponding European Patent Application No. EP12858614.6. Total 8 pages.

(Continued)

*Primary Examiner* — Peter Helvey
(74) *Attorney, Agent, or Firm* — Ostrolenk Faber LLP

(57) ABSTRACT

The present invention relates to an impingement cooling mechanism (1) that ejects a cooling gas (G) toward a cooling target (2) from a plurality of impingement holes (4) formed in an opposing member (3) that is arranged opposite the cooling target (2). Turbulent flow promoting portions (6) are provided in the flow path of a crossflow (CF), which is a flow that is formed by the cooling gas (G) after being ejected from the impingement holes (4). The turbulent flow promoting portions (6) are constituted so that a turbulent flow is promoted from the upstream side to the downstream side of the crossflow (CF).

8 Claims, 6 Drawing Sheets

(52) U.S. Cl.
CPC .. *F05D 2250/241* (2013.01); *F05D 2250/294* (2013.01); *F05D 2260/201* (2013.01); *F05D 2260/2212* (2013.01); *F23R 2900/03042* (2013.01); *F23R 2900/03044* (2013.01); *F23R 2900/03045* (2013.01)

(58) Field of Classification Search
CPC ..... F05D 2250/294; F05D 2260/201; F05D 2260/2212; F01D 5/187; F01D 5/189; F02C 7/16; F23R 3/002; F23R 3/005; F23R 2900/03042; F23R 2900/03044; F23R 2900/03045
USPC ..... 60/752
See application file for complete search history.

(56) References Cited

U.S. PATENT DOCUMENTS 4,592,204 A * 6/1986 Rice ..... F01D 5/185 60/39.17
4,896,499 A * 1/1990 Rice ..... F01D 5/185 60/39.182
4,991,394 A * 2/1991 Wright ..... F02C 7/185 60/226.1
5,100,293 A 3/1992 Anzai et al.
5,144,794 A * 9/1992 Kirikami ..... F01D 5/081 415/115
5,303,544 A * 4/1994 Kobayashi ..... F01K 23/08 60/39.182
5,775,091 A * 7/1998 Bannister ..... F01D 5/084 60/39.17
5,938,975 A * 8/1999 Ennis ..... C06D 5/00 252/373
5,953,900 A * 9/1999 Bannister ..... F01D 25/12 60/39.17
5,983,623 A * 11/1999 Aoki ..... F01D 5/187 415/114
6,065,282 A * 5/2000 Fukue ..... F02C 7/185 415/115
6,089,012 A * 7/2000 Sugishita ..... F01K 23/106 60/39.182
6,094,905 A * 8/2000 Fukuyama ..... F01D 5/06 415/115
6,116,027 A * 9/2000 Smith ..... F02C 6/10 60/648
6,185,924 B1 * 2/2001 Matsumoto ..... F01D 5/082 415/110
6,244,039 B1 * 6/2001 Sugishita ..... F01K 23/106 60/39.182
6,272,844 B1 * 8/2001 Rakhmailov ..... F02C 6/20 416/95
6,321,449 B2 * 11/2001 Zhao ..... 29/890.01
6,324,829 B1 * 12/2001 Kita ..... F01K 23/108 60/39.182
6,367,242 B1 * 4/2002 Uematsu ..... F02C 7/18 60/39.182
6,389,797 B1 * 5/2002 Sugishita ..... F01K 23/106 60/39.182
6,588,197 B2 * 7/2003 Tanaka ..... F01K 23/108 60/39.182
7,416,137 B2 * 8/2008 Hagen ..... F01K 21/047 237/12.1
7,900,458 B2 * 3/2011 James ..... B23P 15/04 415/115
8,297,926 B2 10/2012 Groβ ..... 416/96 R
8,689,566 B1 * 4/2014 Coney ..... F01K 23/103 60/39.5
2001/0023581 A1 * 9/2001 Ojiro ..... F01D 11/24 60/39.182
2002/0174659 A1 * 11/2002 Viteri ..... H01M 8/04022 60/780
2003/0037534 A1 * 2/2003 Sugishita ..... F01K 23/106 60/39.182
2003/0065436 A1 * 4/2003 Hyakutake ..... F01D 19/02 701/100
2004/0003583 A1 * 1/2004 Uematsu ..... F01K 23/106 60/39.182
2004/0139746 A1 * 7/2004 Soechting ..... F01D 9/023 60/752
2005/0066664 A1 * 3/2005 Shibata ..... F02C 7/12 60/775
2006/0120860 A1 6/2006 Dong ..... 415/173.1
2007/0234702 A1 * 10/2007 Hagen ..... B60H 1/032 60/39.01
2007/0295011 A1 * 12/2007 Suciu ..... F01D 5/022 60/772
2011/0016884 A1 * 1/2011 Hashimoto ..... F01D 5/081 60/806
2012/0247121 A1 * 10/2012 Kitamura ..... F01D 11/24 60/785
2012/0247125 A1 * 10/2012 Budmir ..... F01D 9/023 60/805
2014/0090384 A1 * 4/2014 McBrien ..... F23R 3/002 60/754
2014/0096523 A1 * 4/2014 Coney ..... F01K 23/10 60/650
2014/0238028 A1 * 8/2014 Yamane ..... F01D 5/189 60/752
2014/0290256 A1 * 10/2014 Fujimoto ..... F01D 5/189 60/752
2014/0290257 A1 * 10/2014 Okita ..... F01D 5/189 60/752
2015/0096304 A1 * 4/2015 von der Esch ..... F01D 5/06 60/796
2016/0177740 A1 * 6/2016 Slavens ..... F01D 5/187 60/755

FOREIGN PATENT DOCUMENTS

EP 2 236 751 A2 10/2010
EP 2693122 A1 2/2014
EP 2778369 A1 9/2014
EP 2778532 A1 9/2014
JP 63-080004 * 4/1988
JP 09-507549 7/1997
JP 2009-287511 12/2009
WO WO 95/18916 A1 7/1995
WO WO 2008/055737 A1 5/2008

OTHER PUBLICATIONS

Japanese Notice of Allowance, dated Oct. 6, 2015, issued in corresponding Japanese Patent Application No. 2011-274929. Includes English translation. Total 6 pages.
International Search Report and Written Opinion dated Feb. 12 2013 in corresponding PCT International Application No. PCT/JP2012/082314.

* cited by examiner

IMPINGEMENT COOLING MECHANISM, TURBINE BLADE AND CUMBUSTOR

This application is a Continuation of International Application No. PCT/JP2012/082314, filed on Dec. 13, 2012, claiming priority based on Japanese Patent Application No. 2011-274929, filed Dec. 15, 2011, the content of which is incorporated herein by reference in their entity.

TECHNICAL FIELD

The present invention relates to an impingement cooling mechanism, a turbine blade, and a combustor.

BACKGROUND ART

A turbine blade and a combustor, due to being exposed to high-temperature environments, are provided with an impingement cooling mechanism for improving the cooling efficiency by raising the heat transfer coefficient. For example, Patent Document 1 discloses an impingement cooling mechanism in which a plurality of impingement holes are formed in an opposing member that is arranged opposite a cooling target and that ejects cooling gas from the impingement holes.

PRIOR ART DOCUMENTS

Patent Documents

[Patent Document 1] U.S. Pat. No. 5,100,293

DISCLOSURE OF THE INVENTION

Problems to be Solved by the Invention

A crossflow is formed by the cooling gas that has been ejected from the impingement holes flowing in the gap between the cooling target and the opposing member, with the flow rate thereof gradually increasing as it heads downstream due to the addition of the cooling gas that is supplied from the impingement holes to the gap.

Thereby, at the downstream side of the crossflow flowing through the gap between the cooling target and the opposing member, the cooling gas that is ejected from the impingement holes ends up being swept into the crossflow before reaching the cooling target. For this reason, it is difficult to raise the heat-transfer coefficient between the crossflow and the cooling target.

The present invention was achieved in view of the aforementioned circumstances, and has as its object to further raise the cooling efficiency by an impingement cooling mechanism.

Means for Solving the Problems

According to the first aspect of the present invention, an impingement cooling mechanism ejects a cooling gas toward a cooling target from a plurality of impingement holes formed in an opposing member that is arranged opposite the cooling target. Turbulent flow promoting portions are provided in the flow path of a crossflow, which is a flow that is formed by the cooling gas after being ejected from the impingement holes. Also, the turbulent flow promoting portions are constituted so that a turbulent flow is promoted from the upstream side to the downstream side of the crossflow.

According to the second aspect of the present invention, in the impingement cooling mechanism of the first aspect, the turbulent flow promoting portions are arranged on the upstream side of the crossflow with respect to the impingement holes.

According to the third aspect of the present invention, in the impingement cooling mechanism of the first aspect or the second aspect, the number of the impingement holes per unit area is provided so as to be relatively numerous on the upstream side of the crossflow, and relatively few on the downstream side thereof.

According to the fourth aspect of the present invention, the turbulent flow promoting portions are provided on the cooling target side of the impingement cooling mechanism of any one of the first aspect to the third aspect.

According to the fifth aspect of the present invention, the turbulent flow promoting portions have a bump shape in the impingement cooling mechanism of any one of the first aspect to the fourth aspect.

According to the sixth aspect of the present invention, film holes are opened in the cooling target in the impingement cooling mechanism of any one of the first aspect to the fifth aspect.

A turbine blade according to the seventh aspect of the present invention has the impingement cooling mechanism of any one of the first aspect to the sixth aspect.

A combustor according to the eighth aspect of the present invention has the impingement cooling mechanism of any one of the first aspect to the sixth aspect.

Effects of the Invention

According to the present invention, turbulent flow promoting portions are provided in a flow path of a crossflow. Accordingly, by disturbing the flow of the crossflow by the turbulent flow promoting portions, it is possible to raise the heat transfer coefficient between the crossflow and the cooling target.

Also, the turbulent flow promoting portions are constituted so that a turbulent flow is promoted from the upstream side to the downstream side of the crossflow. At the downstream side where the flow rate of the crossflow is large, since it is difficult for the cooling gas that has been ejected from the impingement holes to reach the cooling target, the effect of directly cooling the cooling target by the cooling gas falls. However, since the turbulent flow promoting effect due to the turbulent flow promoting portions becomes high, it is possible to further raise the heat transfer coefficient between the crossflow and the cooling target described above. On the other hand, at the upstream side where the flow rate of the crossflow is small, since the cooling gas that has been ejected from the impingement holes easily reaches the cooling target, it is possible to directly cool the cooling target by the cooling gas.

Thereby, according to the present invention, it is possible to effectively utilize the cooling gas of a limited flow rate that is supplied from the impingement holes, and further improve the cooling effect by impingement cooling.

EMBODIMENTS FOR CARRYING OUT THE INVENTION

Figure 1A:
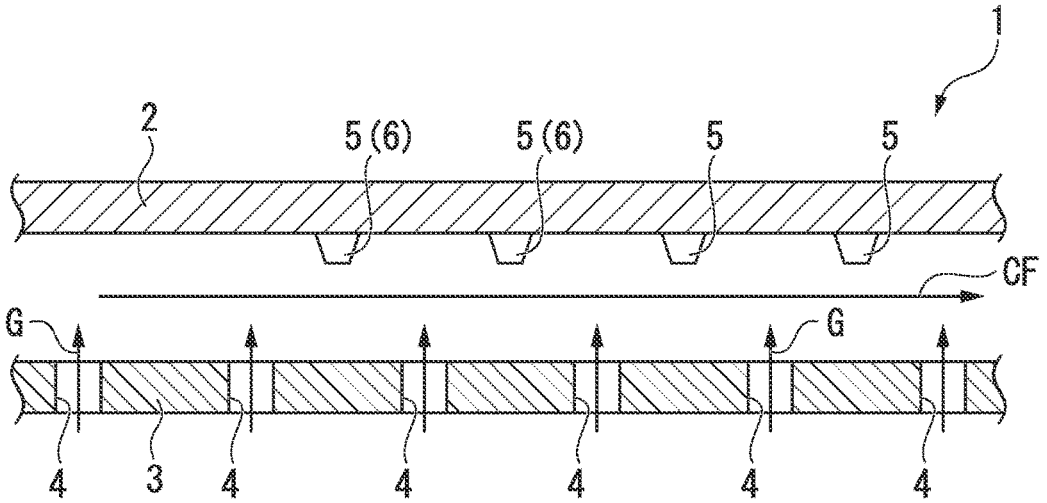
FIG. 1A is a side cross-sectional view that is a schematic illustration showing an outline configuration of the impingement cooling mechanism of the first embodiment of the present invention.

Hereinbelow, details of the present invention shall be described with reference to the drawings. Note that in the drawings given below, the scale of each member is suitably altered in order to make each member a recognizable size.

First Embodiment

Figure 1B:
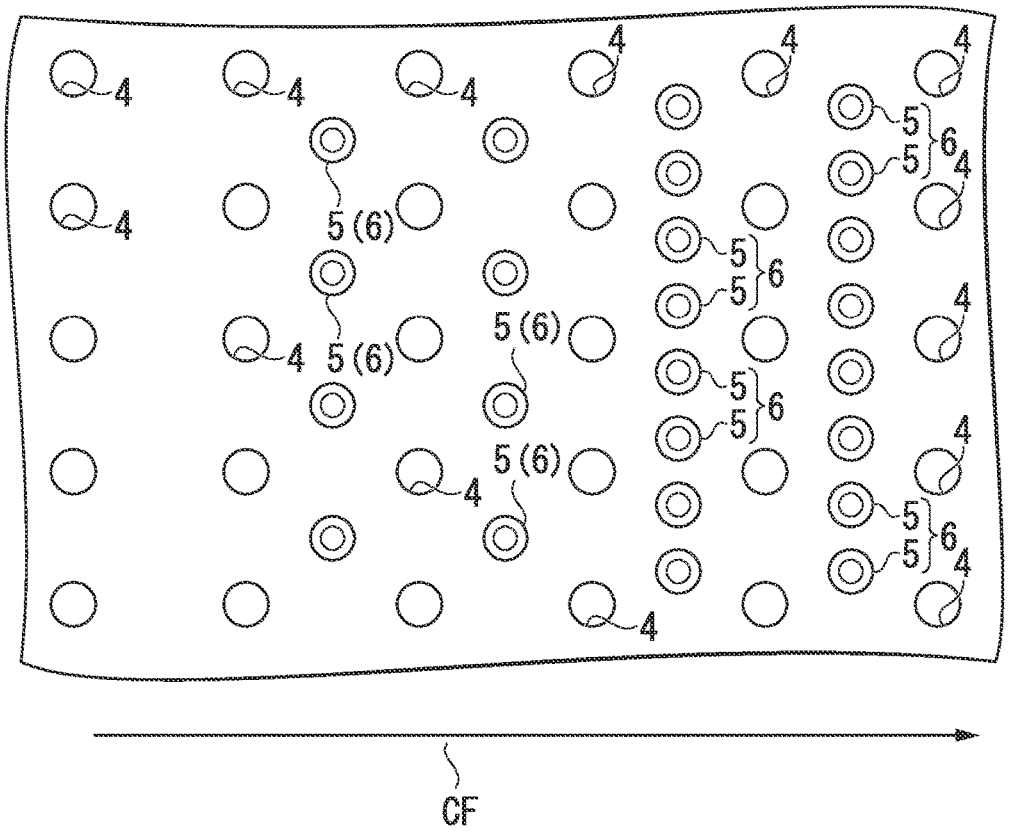
FIG. 1B is a plan view of the cooling target side of the impingement cooling mechanism, seen from the opposing wall side of the impingement cooling mechanism, that is a schematic illustration showing an outline configuration of the impingement cooling mechanism of the first embodiment of the present invention.

FIG. 1A and FIG. 1B are schematic illustrations showing outline configurations of an impingement cooling mechanism 1 of the present embodiment. FIG. 1A is a side cross-sectional view, and FIG. 1B is a plan view of the cooling target side of the impingement cooling mechanism 1 seen from an opposing wall 3 side of the impingement cooling mechanism 1.

As shown in FIG. 1A and FIG. 1B, the impingement cooling mechanism 1 of the present embodiment is provided with a cooling target 2, and the opposing wall 3 (opposing member) that is arranged opposite the cooling target 2. Also, numerous impingement holes 4 are formed in the opposing wall 3, and numerous turbulent flow promoting bodies 5 (turbulent flow promoting portions 6) are formed on the cooling target 2. Note that film holes (not illustrated) are opened in the cooling target 2.

By ejecting a cooling gas G from the impingement holes 4 toward the cooling target 2, the impingement cooling mechanism 1 cools the cooling target 2. The cooling gas G that is ejected from the impingement holes 4 forms a crossflow CF as shown by the arrows in FIG. 1A and FIG. 1B. That is to say, after being ejected from the impingement holes 4 toward the cooling target 2, the cooling gas G flows in the gap between the cooling target 2 and the opposing wall 3, and the flow of the cooling gas G becomes the crossflow CF.

The impingement hole 4 is formed penetrating the opposing wall 3, and has a circular opening. In the present embodiment, as shown in FIG. 1B, the plurality of impingement holes 4 are arranged in a regular manner in the horizontal and vertical directions on the outer surface of the opposing wall 3 (the surface on the cooling target 2 side). That is to say, these impingement holes 4 are arranged at equal intervals along the flow direction of the crossflow CF, shown by an arrow in FIG. 1B, and arranged at equal intervals also in the direction perpendicular to the flow direction of the crossflow CF.

Accordingly, when the crossflow CF flows from upstream to downstream, as shown in FIG. 1A, the cooling gas G continuously flows into the crossflow CF from the impingement holes 4 that are provided in the flow path thereof, and merges. For this reason, the flow rate of the crossflow CF gradually increases as it heads toward downstream.

Figure 2A:
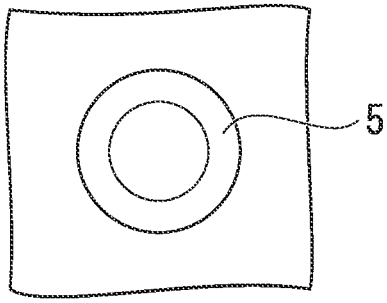
FIG. 2A is a plan view that shows an outline configuration of a turbulent flow promoting body with a bump shape.
Figure 2B:
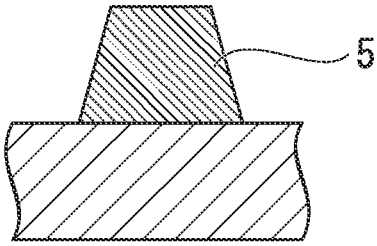
FIG. 2B is a side view that shows an outline configuration of a turbulent flow promoting body with a bump shape.
Figure 2C:
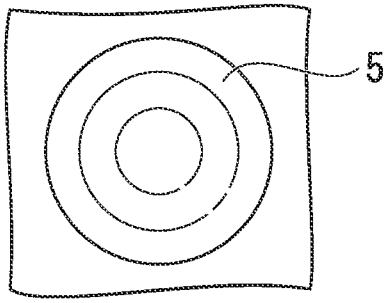
FIG. 2C is a plan view that shows an outline configuration of a turbulent flow promoting body with a bump shape.
Figure 2D:
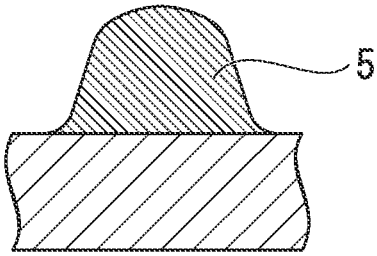
FIG. 2D is a side view that shows an outline configuration of a turbulent flow promoting body with a bump shape.

The turbulent flow promoting body 5 constitutes the turbulent flow promoting portion 6 according to the present invention, and exists singularly or in a plurality. In the present embodiment, the turbulent flow promoting body 5 is a projection with a bump shape, that is to say, a truncated cone shape as shown in FIG. 2A and FIG. 2B. Alternatively, the turbulent flow promoting body 5 is a projection with a bump shape as shown in FIG. 2C and FIG. 2D, that is to say, an approximately truncated cone shape in which the top surface side and bottom surface side of the truncated cone shape deform to be gently sloped. A plurality of the turbulent flow promoting bodies 5 are formed with the same size and shape in the present embodiment. These turbulent flow promoting bodies 5, as shown in FIG. 1B, are provided in the flow path of the crossflow CF, that is to say, in the region in which the impingement holes 4 are arrayed.

These turbulent flow promoting bodies 5 are arranged in a fewer number at the upstream side of the crossflow CF, and in a greater number at the downstream side thereof. In FIG. 1B that gives a schematic representation, at the left side of the page, which is the upstream side of the crossflow CF, the turbulent flow promoting body 5 is not provided, and heading to the downstream side of the crossflow CF, the number of the turbulent flow promoting bodies 5 increases. That is to say, at the downstream side of the crossflow CF along the flow direction, about one turbulent flow promoting body 5 is arranged per one impingement hole 4. Further to the downstream side, about two turbulent flow promoting bodies 5 are arranged per one impingement hole 4. Note that although not illustrated in the drawing, heading further to the downstream side, the number of turbulent flow promoting bodies 5 that are arranged gradually increases, such that about three turbulent flow promoting bodies 5 are arranged, and moreover about four turbulent flow promoting bodies 5 are arranged per one impingement hole 4.

Also, in the present embodiment, as shown in FIG. 1B, the turbulent flow promoting bodies 5 are not arranged along the arrangement direction of the impingement holes 4 in the flow direction of the crossflow CF. The turbulent flow promoting bodies 5 are arranged in a manner shifted from that arrangement direction. For example, in the region where roughly one turbulent flow promoting body 5 is arranged per one impingement hole 4, one turbulent flow promoting body 5 is arranged at the central portion of four impingement holes 4 that are arranged in the horizontal and vertical directions of the cooling target 2. Also, in the region where roughly two turbulent flow promoting bodies 5 are arranged per one impingement hole 4, two turbulent flow promoting bodies 5 are arranged side by side at the central portion of four impingement holes 4 that are arranged in the horizontal and vertical directions of the cooling target 2.

In the present embodiment, the turbulent flow promoting portion 6 according to the present invention is constituted by one or a plurality of the turbulent flow promoting bodies 5 being arranged at the same position (central portion). That is to say, in the case of one turbulent flow promoting body 5 being arranged at the central portion of the four impingement holes 4 that are arranged in the horizontal and vertical directions, the turbulent flow promoting portion 6 according to the present invention is constituted by the one turbulent flow promoting body 5. Also, in the case of two turbulent flow promoting bodies 5 being arranged at the central portion of the four impingement holes 4 that are arranged in the horizontal and vertical directions, the turbulent flow promoting portion 6 according to the present invention is constituted by these two turbulent flow promoting bodies 5.

These turbulent flow promoting bodies 5 (turbulent flow promoting portion 6) disturb the flow of the crossflow CF, and generate a turbulent flow in the gap between the cooling target 2 and the opposing wall 3. Thereby, these turbulent flow promoting bodies 5 (turbulent flow promoting portion 6) function so as to raise the heat transfer coefficient between the crossflow CF (turbulent flow) and the cooling target 2.

As described above, the two turbulent flow promoting bodies 5 that are arranged side by side are lined up in a direction perpendicular to the flow direction of the crossflow CF. Accordingly, the turbulent flow promoting portions 6 each consisting of two turbulent flow promoting bodies 5 that are arranged side by side have a greater surface area in contact with the crossflow CF compared to the turbulent flow promoting portions 6 each consisting of one turbulent flow promoting body 5 arranged on the upstream side thereof. Thereby, the turbulent flow promoting effect is relatively higher for the turbulent flow promoting portions 6 that are arranged on the downstream side compared to the turbulent flow promoting portions 6 that are arranged on the upstream side.

That is to say, in the present embodiment, the turbulent flow promoting portions 6 that consist of the turbulent flow promoting bodies 5 are arranged few in number on the upstream side and many in number on the downstream side. Thereby, the turbulent flow promoting effect is relatively low on the upstream side of the crossflow CF, and the turbulent flow promoting effect is relatively high on the downstream side.

In the impingement cooling mechanism 1 of the present embodiment, the turbulent flow promoting portion 6 consisting of the turbulent flow promoting body 5 is provided in the flow path of the crossflow CF. For that reason, by disturbing the flow of the crossflow CF by the turbulent flow promoting portion 6, it is possible to raise the heat transfer coefficient between the crossflow CF and the cooling target 2.

Also, the number of the turbulent flow promoting bodies 5 that constitute each turbulent flow promoting portion 6 is made few on the upstream side of the crossflow CF and made more on the downstream side. For that reason, the turbulent flow promoting effect of the turbulent flow promoting portion 6 is relatively low on the upstream side of the crossflow CF, and the turbulent flow promoting effect is relatively high on the downstream side. Thereby, at the downstream side where the flow rate of the crossflow CF is large, it is difficult for the cooling gas G that has been ejected from the impingement holes 4 to reach the cooling target 2. For this reason, the effect of directly cooling the cooling target 2 by the cooling gas G falls. However, since the turbulent flow promoting effect due to the turbulent flow promoting portions 6 increases at the downstream side where the flow rate of the crossflow CF is high, it is possible to further raise the heat transfer coefficient between the crossflow CF and the cooling target 2 described above.

On the other hand, at the upstream side where the flow rate of the crossflow CF is small, the cooling gas G that has been ejected from the impingement holes 4 easily reaches the cooling target 2. For this reason, it is possible to directly cool the cooling target 2 by the cooling gas G.

Also, even on the downstream side of the crossflow CF, the impingement holes 4 are arranged in the same manner as on the upstream side. Accordingly, by ejecting the cooling gas G from the impingement holes 4, it is possible to cool not only the cooling target 2 but also the crossflow CF that has flowed from the upstream side and been warmed by heat exchange along the way.

Moreover, the turbulent flow promoting bodies 5 function as fins by being formed on the cooling target 2. Accordingly, by once blocking the flow (crossflow CF) of the cooling gas G that has flowed in from the impingement holes 4, the turbulent flow promoting bodies 5 transmit the coldness of the cooling gas G to the cooling target 2, and cool the cooling target 2.

Thereby, according to the present embodiment, it is possible to effectively utilize the cooling gas G of a limited flow rate that is supplied from the impingement holes 4, and further improve the cooling effect by the impingement cooling.

Second Embodiment

Figure 3A:
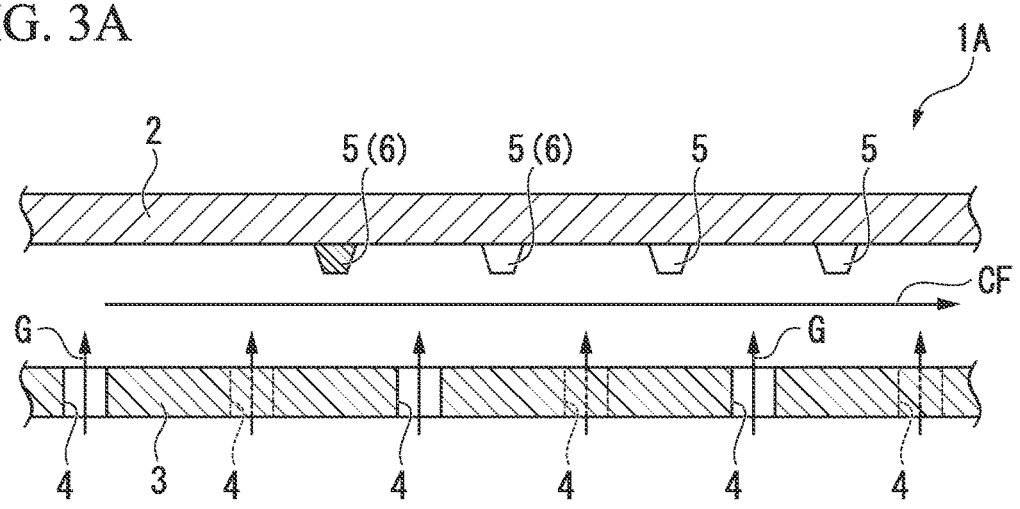
FIG. 3A is a side cross-sectional view that is a schematic view showing an outline configuration of the impingement cooling mechanism of the second embodiment of the present invention.
Figure 3B:
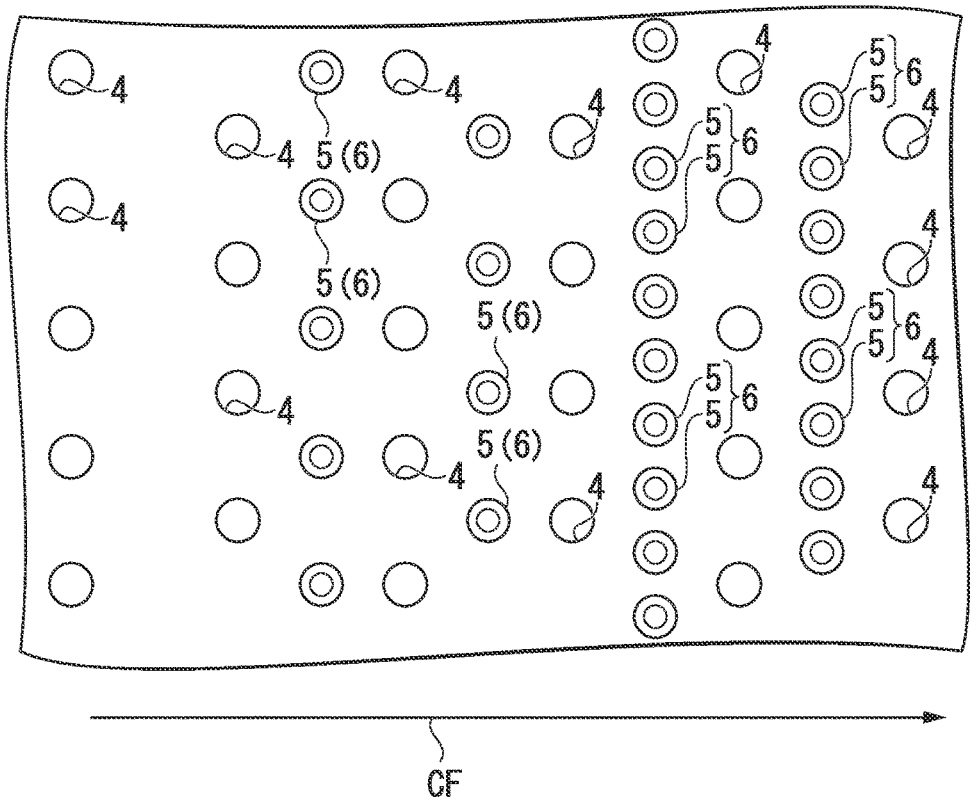
FIG. 3B is a plan view of the cooling target side of the impingement cooling mechanism, seen from the opposing wall side of the impingement cooling mechanism, that is a schematic illustration showing an outline configuration of the impingement cooling mechanism of the second embodiment of the present invention.

FIG. 3A and FIG. 3B are schematic drawings showing outline configurations of an impingement cooling mechanism 1A of the present embodiment. FIG. 3A is a side cross-sectional view, and FIG. 3B is a plan view of the cooling target side of the impingement cooling mechanism 1A seen from the opposing wall side of the impingement cooling mechanism 1A. The impingement cooling mechanism 1A of the present embodiment mainly differs from the impingement cooling mechanism 1 of the first embodiment shown in FIG. 1A and FIG. 1B on the points of the arrangement of the impingement holes 4, and the arrangement of the turbulent flow promoting bodies 5 with respect to the impingement holes 4.

In the impingement cooling mechanism 1A of the present embodiment, the arrangement of the impingement holes 4 differs from the impingement cooling mechanism 1 shown in FIG. 1B. That is to say, the impingement holes 4 of the first embodiment are arranged in a regular manner horizontally and vertically. The impingement holes 4 in the present embodiment are arranged in a staggered manner as shown in FIG. 3B.

Meanwhile, similarly to the first embodiment, the turbulent flow promoting bodies 5 are arranged few in number on the upstream side of the crossflow CF and many in number on the downstream side. Thereby, the turbulent flow promoting effect of the turbulent flow promoting portion 6 is relatively low on the upstream side of the crossflow CF, and the turbulent flow promoting effect is relatively high on the downstream side.

Also, in the present embodiment, the turbulent flow promoting portion 6 (turbulent flow promoting body 5) is arranged on the upstream side of the crossflow CF with respect to the nearest impingement hole 4 on the downstream side of the crossflow CF. That is to say, the turbulent flow promoting portion 6 (turbulent flow promoting body 5) is arranged on the upstream side of the direction along the flow direction of the crossflow CF.

According to the aforementioned constitution, the turbulent flow promoting portion 6 (turbulent flow promoting body 5) functions as an obstacle that inhibits intrusion of the crossflow CF into a region between the impingement hole 4 and the cooling target 2 positioned on the downstream side of the turbulent flow promoting portion 6. The turbulent flow promoting body 5 of the turbulent flow promoting portion 6 increases in number toward the downstream. Accordingly, the function of the turbulent flow promoting portion 6 (turbulent flow promoting body 5) as an obstacle also increases toward the downstream.

In the impingement cooling mechanism 1A of the present embodiment, in addition to the same effects as the first embodiment, it also inhibits the intrusion of the crossflow CF into the region between the impingement hole 4 and the cooling target 2. Thereby, it is possible to prevent the cooling gas G that is ejected from the impingement holes 4 from being swept into the crossflow CF before reaching the cooling target 2, and inhibit a drop in the effect of cooling the cooling target 2.

Therefore, according to the present embodiment, it is possible to effectively utilize the cooling gas G of a limited flow rate that is supplied from the impingement holes 4, and further improve the cooling effect by the impingement cooling.

Third Embodiment

Figure 4A:
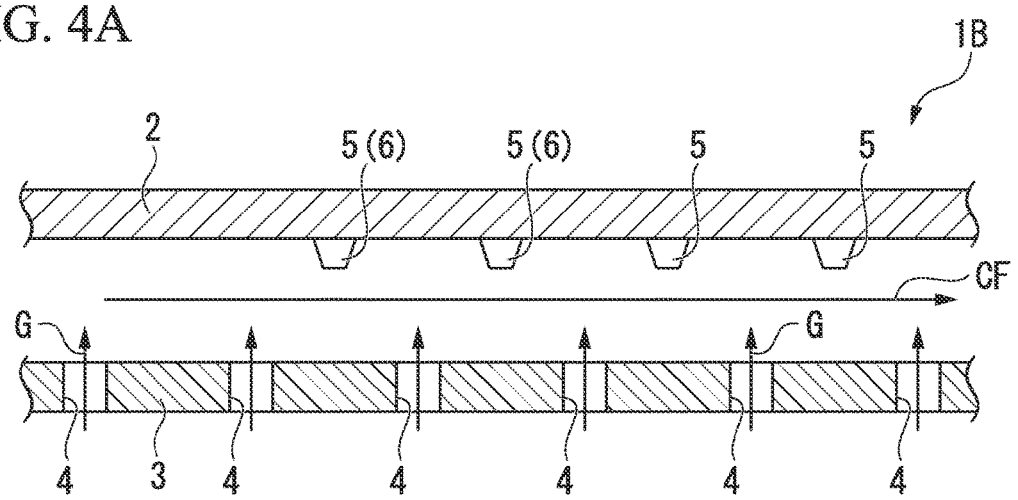
FIG. 4A is a side cross-sectional view that is a schematic illustration showing an outline configuration of the impingement cooling mechanism of the third embodiment of the present invention.
Figure 4B:
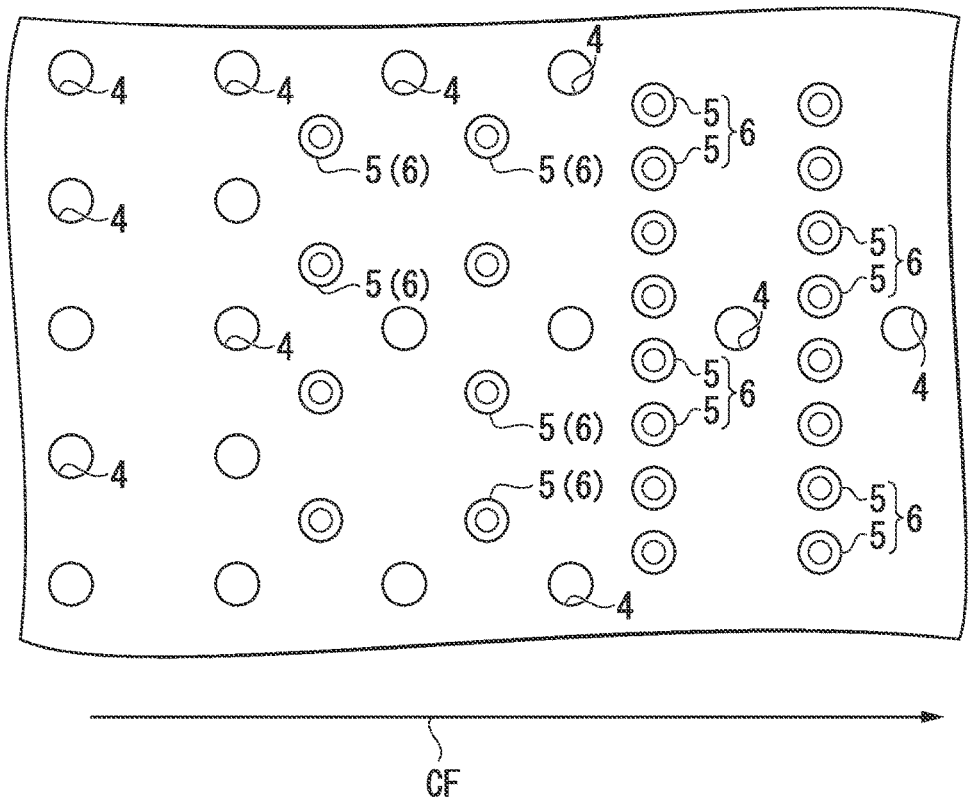
FIG. 4B is a plan view of the cooling target side of the impingement cooling mechanism, seen from the opposing wall side of the impingement cooling mechanism, that is a schematic illustration showing an outline configuration of the impingement cooling mechanism of the third embodiment of the present invention.

FIG. 4A and FIG. 4B are schematic drawings showing outline configurations of an impingement cooling mechanism 1B of the present embodiment. FIG. 4A is a side cross-sectional view, and FIG. 4B is a plan view of the cooling target side of the impingement cooling mechanism 1B seen from the opposing wall side of the impingement cooling mechanism 1B. The impingement cooling mechanism 1B of the present embodiment mainly differs from the impingement cooling mechanism 1 of the first embodiment shown in FIG. 1A and FIG. 1B on the point of the arrangement (that is to say, the distribution state) of the impingement holes 4.

In the impingement cooling mechanism 1B of the present embodiment, as shown in FIG. 4B, the number of the impingement holes 4 per unit area is provided so as to be relatively numerous on the upstream side of the crossflow CF, and relatively few on the downstream side. In FIG. 4B in which it is schematically shown, 10 (5 holes×2 rows) of the impingement holes 4 are provided per unit area on the upstream side of the crossflow CF (left side of the drawing). On the downstream side of the crossflow CF (middle portion of the drawing), six (3 holes×2 rows) of the impingement holes 4 are provided per unit area. Further to the downstream side (right side of the drawing), two (1 hole×2 rows) of the impingement holes 4 are provided per unit area.

When the impingement holes 4 are arranged as described above, the flow rate of the crossflow CF is relatively small at the upstream side of the crossflow CF. For that reason, as stated above, the cooling gas G that is ejected from the impingement holes 4 is hardly affected by the crossflow CF. Since the cooling gas G easily reaches the cooling target 2, it is possible to directly cool the cooling target 2 with the cooling gas G. That is to say, on the upstream, direct cooling by the cooling gas G is mainly performed, in the same manner as the first embodiment and the second embodiment.

On the other hand, at the downstream where the flow rate of the crossflow CF is large, as described above, the effect of directly cooling the cooling target 2 by the cooling gas G decreases. However, heightening the turbulent flow promoting effect with the turbulent flow promoting portions 6 further raises the heat transfer coefficient between the crossflow CF and the cooling target 2. Accordingly, even in the case of making the number of impingement holes 4 fewer at the downstream and reducing the ejection amount of the cooling gas G; as described above, cooling by the crossflow CF based on the turbulent flow promoting effect of the turbulent flow promoting portions 6 is mainly performed at the downstream. For this reason, compared to the first embodiment and the second embodiment, the reduction of the cooling effect at the downstream is slight.

On the other hand, if the total amount of the cooling gas G that is ejected from all of the impingement holes 4 is assumed to be constant, since the amount of the cooling gas G ejected at the upstream increases, it is possible to further boost the cooling effect at the upstream. Accordingly, it is possible to raise the cooling effect in a range of the entire device from the upstream to the downstream.

Thereby, according to the present embodiment, it is possible to effectively utilize the cooling gas G of a limited flow rate that is supplied from the impingement holes 4, and further improve the cooling effect by the impingement cooling.

Note that in the embodiments using the turbulent flow promoting body 5 that consists of a projection with a bump shape as the turbulent flow promoting portion 6, changing the number of the bodies forms a difference in the level of the turbulent flow promoting effect. However, for example the number of the turbulent flow promoting bodies 5 may be kept the same (for example, 1 body), and a difference in the level of its turbulent flow promoting effect may be imparted by changing its size.

Figure 5A:
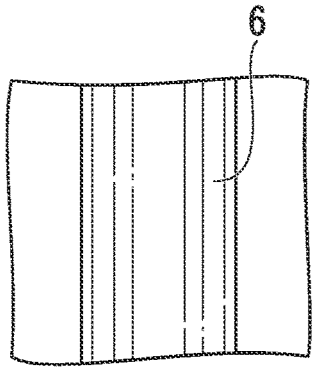
FIG. 5A is a plan view that is an illustration showing an outline configuration of a turbulent flow promoting body.
Figure 5B:
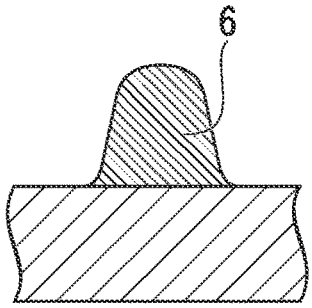
FIG. 5B is a side view that shows an outline configuration of a turbulent flow promoting body.

Also, instead of the turbulent flow promoting body 5 that consists of a bump-shaped projection, it is also possible to use a rib-shaped or plate-shaped turbulent flow promoting portion 6 as shown in FIG. 5A and FIG. 5B. In that case, by for example changing the height or the width of the rib-shaped or plate-shaped turbulent flow promoting portion 6, it is possible to form a difference in the turbulent flow promoting effect. That is to say, by increasing the height or widening the width, it is possible to raise the turbulent flow promoting effect.

Figure 5C:
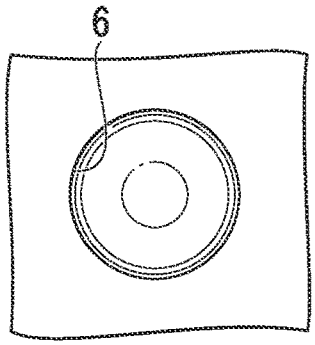
FIG. 5C is a plan view that shows an outline configuration of a turbulent flow promoting body.
Figure 5D:
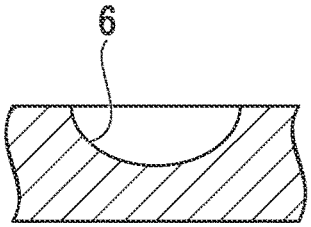
FIG. 5D is a side view that shows an outline configuration of a turbulent flow promoting body.

Moreover, it is also possible to use a dimple (concavity) as shown in FIG. 5C and FIG. 5D as the turbulent flow promoting portion 6. In that case, by for example changing the depth or diameter of the turbulent flow promoting portion 6, it is possible to impart a difference in the turbulent flow promoting effect. That is to say, by deepening the depth of the dimple, or increasing the diameter of the dimple, it is possible to raise the turbulent flow promoting effect. Also, similarly to the case of the projection, by changing the number of the dimples, it is possible to form a difference in the turbulent flow promoting effect.

Also, in the embodiments, the opening shape of the impingement hole 4 is made circular, but it is possible to adopt various shapes for the opening shape. For example, it may be a race-track shape that is formed by two parallel sides and arcs that connect these two sides, or a flat shape such as an elliptical shape. In that case, it is preferable for the opening width in the flow direction of the crossflow CF to be formed greater than the opening width in the direction perpendicular to the flow direction of the crossflow CF.

If the impingement hole with the aforementioned flat shape is used, the opening width in the flow direction of the crossflow CF is large. For this reason, it is possible to make the opening width viewed from the flow direction of the crossflow CF smaller than the circular impingement hole 4 that ejects the cooling gas G of the same flow rate. As a result, it is possible to make the collision region between the crossflow CF and the flow of the cooling gas G that is ejected from the flat impingement hole 4 in the gap between the cooling target 2 and the opposing wall 3 narrower than the case of a circular impingement hole. That is, it is possible to reduce the influence of the crossflow CF on the flow of the cooling gas G. Thereby, compared to the case of ejecting the cooling gas G from the round impingement hole 4, it is possible to cause more of the cooling gas G to reach the cooling target 2.

(Turbine Blade and Combustor)

Figure 6A:
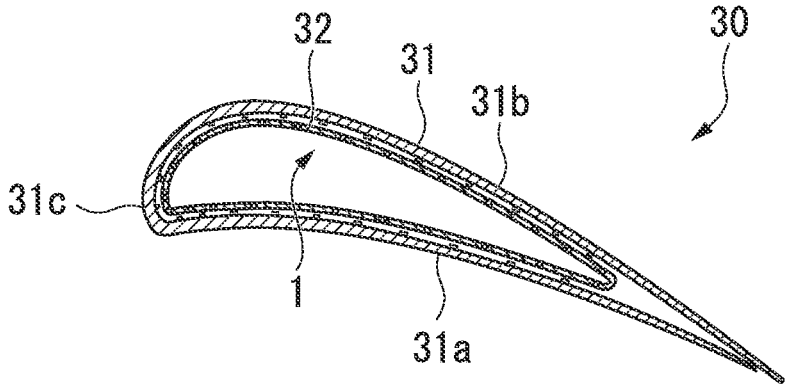
FIG. 6A is a cross-sectional view of a turbine blade that is a schematic illustration showing a turbine blade that is provided with the impingement cooling mechanism of the present invention.
Figure 6B:
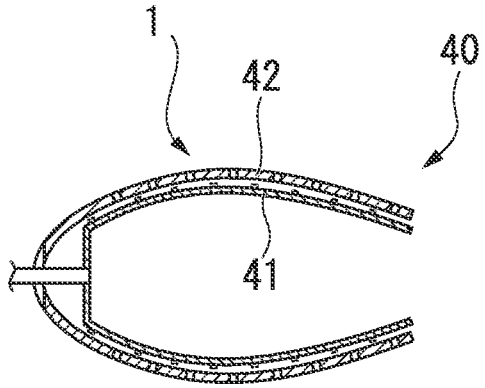
FIG. 6B is a cross-sectional view of a combustor that is a schematic illustration showing a combustor that is provided with the impingement cooling mechanism of the present invention.

FIG. 6A and FIG. 6B are schematic drawings that show a turbine blade 30 and a combustor 40 provided with the impingement cooling mechanism 1 of the first embodiment. FIG. 6A is a cross-sectional view of a turbine blade, and FIG. 6B is a cross-sectional view of a combustor.

As shown in FIG. 6A, the turbine blade 30 has a double-shell structure that is provided with an outer wall 31 and an inner wall 32. The outer wall 31 corresponds to the aforementioned cooling target 2, while the inner wall 32 corresponds to the aforementioned opposing wall 3. The turbine blade 30 is provided with the impingement cooling mechanism 1 having impingement holes provided in the inner wall 32, and turbulent flow promoting portions provided on the outer wall 31. The impingement cooling mechanism 1 can be applied to a front side blade surface (blade front) 31*a* and a back side blade surface 31*b* having a planar shape, and can also be applied to a leading edge portion 31*c* having a curved shape in the turbine blade 30.

According to the impingement cooling mechanism 1 of the first embodiment, it is possible to improve the cooling efficiency by increasing the heat transfer coefficient. Therefore, the turbine blade 30 provided with the impingement cooling mechanism 1 has excellent heat resistance.

As shown in FIG. 6B, the combustor 40 has a double-shell structure that is provided with an inner liner 41 and an outer liner 42. The inner liner 41 corresponds to the cooling target 2 mentioned above, while the outer liner 42 corresponds to the aforementioned opposing wall 3. The combustor 40 is provided with the impingement cooling mechanism 1 having impingement holes provided in the outer liner 42, and turbulent flow promoting portions provided on the inner liner 41.

According to the impingement cooling mechanism 1 of the first embodiment, it is possible to improve the cooling efficiency by increasing the heat transfer coefficient. For that reason, the combustor 40 that is provided with the impingement cooling mechanism 1 has excellent heat resistance.

Note that it is also possible to adopt constitutions of the turbine blade 30 and the combustor 40 being provided with the impingement cooling mechanism 1A of the second embodiment or the impingement cooling mechanism 1B of the third embodiment instead of the impingement cooling mechanism 1 of the first embodiment.

Hereinabove, preferred embodiments of the present invention have been described with reference to the appended drawings, but the present invention is not limited to the aforementioned embodiments. The various shapes and combinations of each constituent member shown in the embodiments refer to only examples, and may be altered in various ways based on design requirements and so forth within a scope that does not deviate from the subject matter of the present invention.

INDUSTRIAL APPLICABILITY

According to the present invention, it is possible to obtain an impingement cooling mechanism, a turbine blade, and a combustor that can effectively utilize the cooling gas of a limited flow rate that is supplied from impingement holes, and further enhance the cooling effect by impingement cooling.

DESCRIPTION OF THE REFERENCE SYMBOLS

1: impingement cooling mechanism; 2: cooling target; 3: opposing wall (opposing member); 4: impingement hole; 5: turbulent flow promoting body; 6: turbulent flow promoting portion; 30: turbine blade; 31: outer wall; 32: inner wall; 40: combustor; 41: inner liner; 42: outer liner; G: cooling gas; CF: crossflow

The invention claimed is:

1. An impingement cooling mechanism that ejects a cooling gas toward a cooling target from a plurality of impingement holes formed in an opposing member that is arranged opposite the cooling target, wherein turbulent flow promoting portions formed in the cooling target are provided in a flow path of a crossflow so as to oppose the impingement holes, the crossflow being a flow that is formed by the cooling gas after being ejected from the impingement holes;

a number of the turbulent flow promoting bodies that constitute each turbulent flow promoting portions in an upstream side of the crossflow is set smaller than a number of the turbulent flow promoting bodies that constitute each turbulent flow promoting portions in a downstream side of the crossflow; and the turbulent flow promoting portions are constituted so that a turbulent flow is promoted from the upstream side to the downstream side of the crossflow.

2. The impingement cooling mechanism according to claim 1, wherein the turbulent flow promoting portions are arranged on the upstream side of the crossflow with respect to the impingement holes.

3. The impingement cooling mechanism according to claim 1, wherein the number of the impingement holes per unit area is provided so as to be relatively numerous on the upstream side of the crossflow, and relatively few on the downstream side thereof.

4. The impingement cooling mechanism according to claim 1, wherein the turbulent flow promoting portions are provided on the cooling target side of the impingement cooling mechanism.

5. The impingement cooling mechanism according to claim 1, wherein the turbulent flow promoting portions have a bump shape.

6. The impingement cooling mechanism according to claim 1, wherein film holes are opened in the cooling target.

7. A turbine blade comprising the impingement cooling mechanism according to claim 1.

8. A combustor comprising the impingement cooling mechanism according to claim 1.

* * * * *